US006080948A

United States Patent [19]

Hong

[11] Patent Number: 6,080,948

[45] Date of Patent: Jun. 27, 2000

[54] PUSHBUTTON STRUCTURE OF COMPUTER KEYBOARD

[75] Inventor: Ming-Yow Hong, Yung-Ho, Taiwan

[73] Assignee: Hon Hai Precision Ind. Co., Ltd, Taipei Hsien, Taiwan

[21] Appl. No.: 09/354,526

[22] Filed: Jul. 15, 1999

[30] Foreign Application Priority Data

Dec. 31, 1998 [TW] Taiwan ..... 87222083

[51] Int. Cl.[7] ..... H01N 13/70

[52] U.S. Cl. ..... 200/344

[58] Field of Search ..... 200/5 A, 512, 200/517, 341, 344, 345; 400/472, 490, 491.2, 495, 495.1

[56] References Cited

U.S. PATENT DOCUMENTS

| | | | |
|---|---|---|---|
| 5,278,371 | 1/1994 | Watanabe et al. | 200/344 |
| 5,504,283 | 4/1996 | Kako et al. | 200/5 A |
| 5,850,194 | 12/1998 | Lin | 341/22 |
| 5,878,872 | 3/1999 | Tsai | 200/344 |
| 5,894,117 | 4/1999 | Kamishima | 200/344 |
| 5,898,145 | 4/1999 | Su | 200/344 |
| 5,924,553 | 7/1999 | Yeh | 200/344 |

*Primary Examiner*—Michael Friedhofer
*Attorney, Agent, or Firm*—Wei Te Chung

[57] ABSTRACT

A computer keyboard pushbutton structure includes a base plate on which a pair of pivotally attached link members forming a collapsible cross configuration is supported. A key cap is supported on the link members and movable with the collapse of the cross configuration of the link members. A membrane circuit is positioned on and supported by the base plate. The membrane circuit includes an insulative film on which a contact switch and corresponding conductive traces are formed. The insulative film defines openings through which the link members extend to contact and thus be directly supported by the base plate. A rubber cap is supported on the membrane circuit and coupled to the key cap for being deformable by depression of the key cap whereby a projection of the rubber cap contacts and thus actuates the contact switch.

9 Claims, 4 Drawing Sheets

PUSHBUTTON STRUCTURE OF COMPUTER KEYBOARD

BACKGROUND OF THE INVENTION

1. Field of the Invention

The present invention generally relates to a computer keyboard, and in particular to a pushbutton structure of a computer keyboard.

2. The Prior Art

A computer keyboard having a number of pushbuttons selectively actuateable by a user is commonly used as computer input means. Examples of computer keyboards are disclosed in Taiwan Patent Application Nos. 86209186, 86210322, 86207495, 86201498 and 86207350. FIG. 1 of the attached drawings shows an example of a conventional pushbutton structure of a computer keyboard. The conventional pushbutton structure comprises a base 7 on which a membrane circuit 6 is positioned. A positioning board 5 is positioned on the membrane circuit 6. A rubber cap 4 is fixed on the positioning board 5 and is deformable upon being depressed for contacting and actuating the membrane circuit 6. A support plate 3 is fit over the rubber cap 4 and supported on the positioning board 5 for supporting a pair of link members 2 which are pivotally attached to each other to form a collapsible cross configuration. A key cap 1 is supported by the link members 2 whereby depressing the key cap 1 causes deformation of the rubber cap 4 for actuating the membrane circuit 6. The conventional pushbutton structure is complicated and costly. Furthermore, the complicated structure does not promote miniaturization of the keyboard.

It is thus desired to have a pushbutton structure of a computer keyboard which has a simple structure and which can be manufactured at a low cost.

SUMMARY OF THE INVENTION

Accordingly, an object of the present invention is to provide a simplified pushbutton structure of a computer keyboard.

Another object of the present invention is to provide a pushbutton structure of a computer keyboard which can be manufactured at a low cost.

A further object of the present invention is to provide a pushbutton structure of a computer keyboard having a reduced dimension.

To achieve the above objects, a pushbutton structure of a computer keyboard in accordance with the present invention comprises a base plate on which a pair of pivotally attached link members forming a collapsible cross configuration is supported. A key cap is supported on the link members and movable with the collapse of the cross configuration of the link members. A membrane circuit is positioned on and supported by the base plate. The membrane circuit includes an insulative film on which a contact switch and corresponding conductive traces are formed. The insulative film defines openings through which the link members extend to contact and thus be directly supported by the base plate. A rubber cap is supported on the membrane circuit and coupled to the key cap for being deformable by depression of the key cap whereby a projection of the rubber cap contacts and thus actuates the contact switch.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
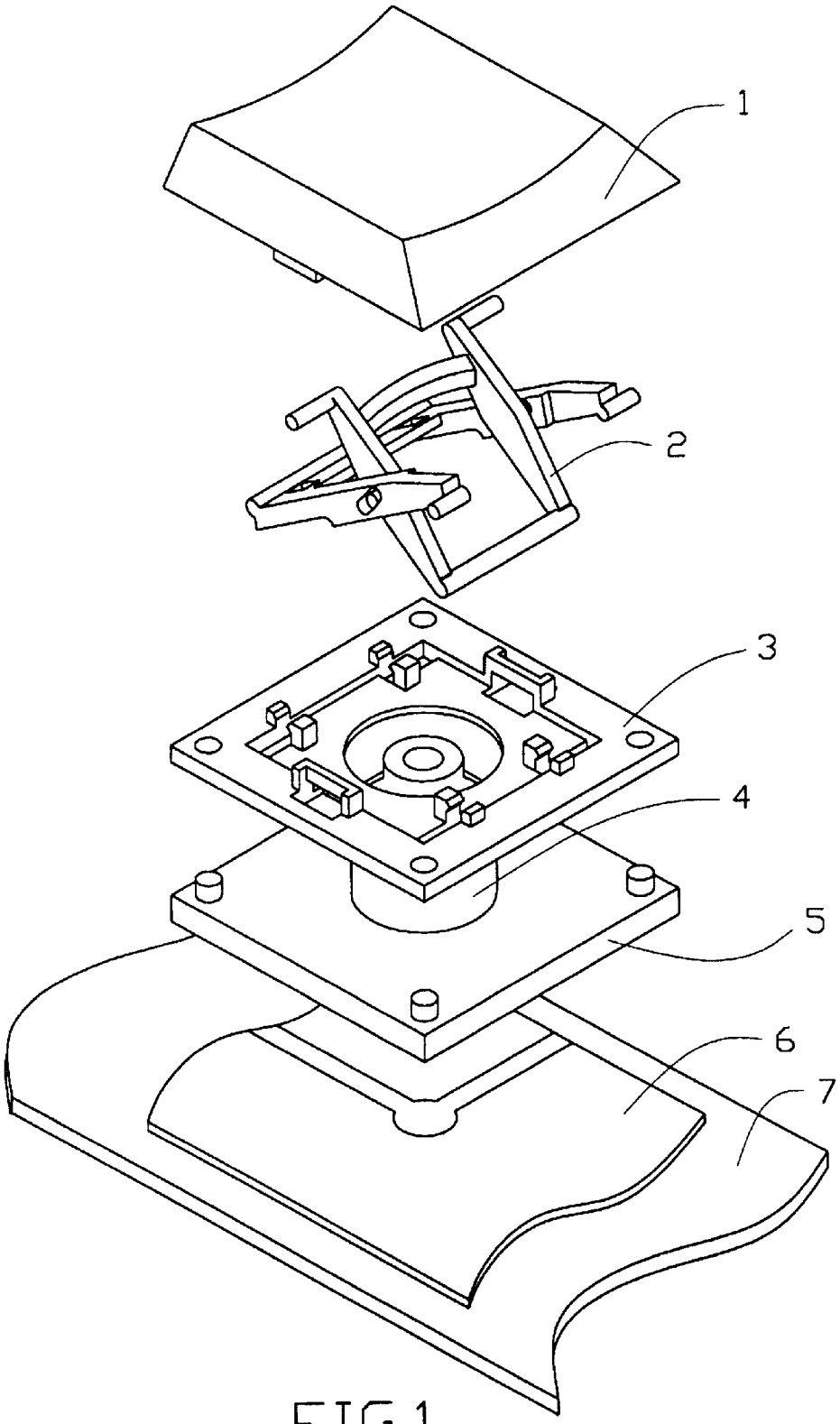
FIG.1 (PRIOR ART)
FIG. 1 is an exploded view of a conventional pushbutton structure of a computer keyboard.
Figure 2:
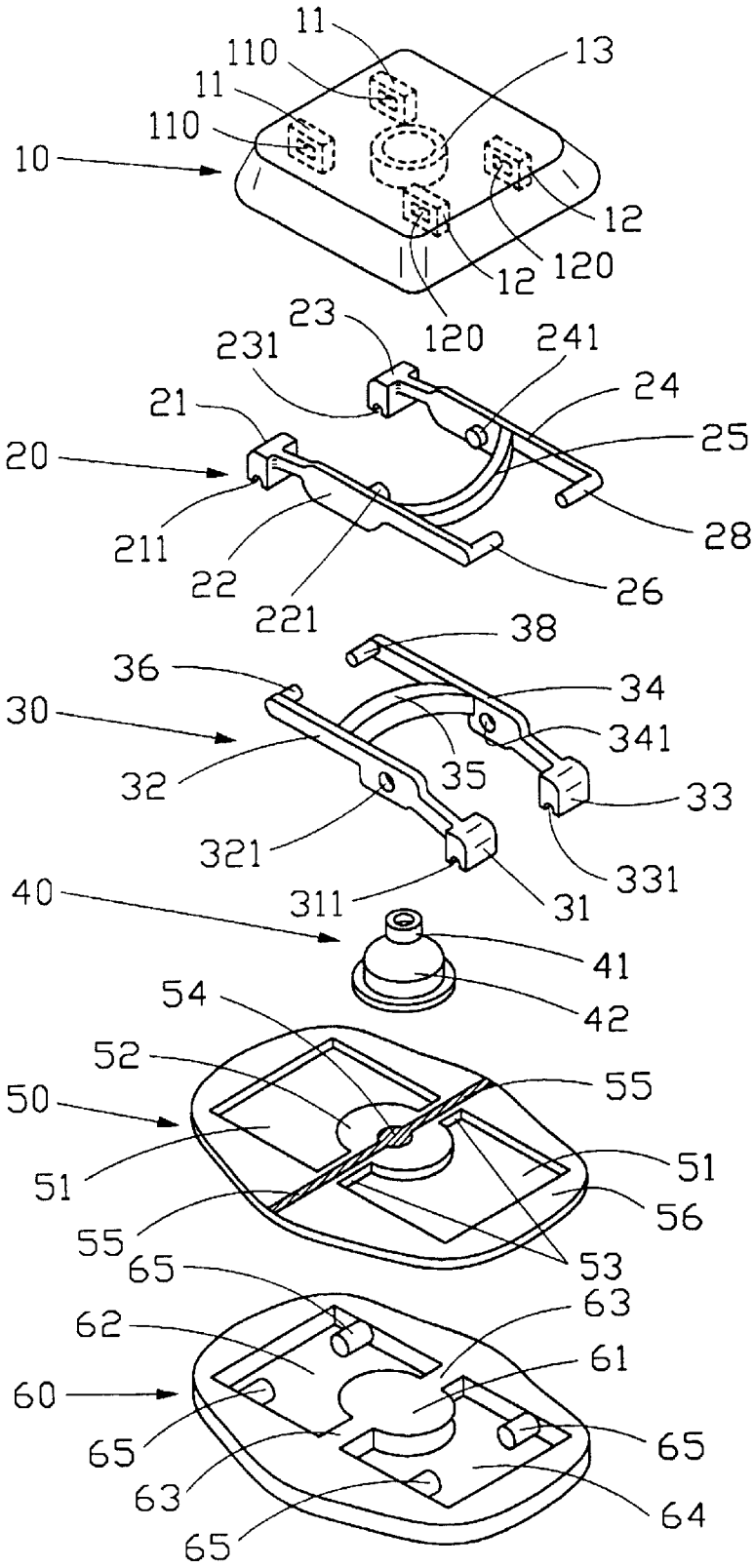
FIG. 2 is an exploded view of a pushbutton structure of a computer keyboard in accordance with the present invention.
Figure 3:
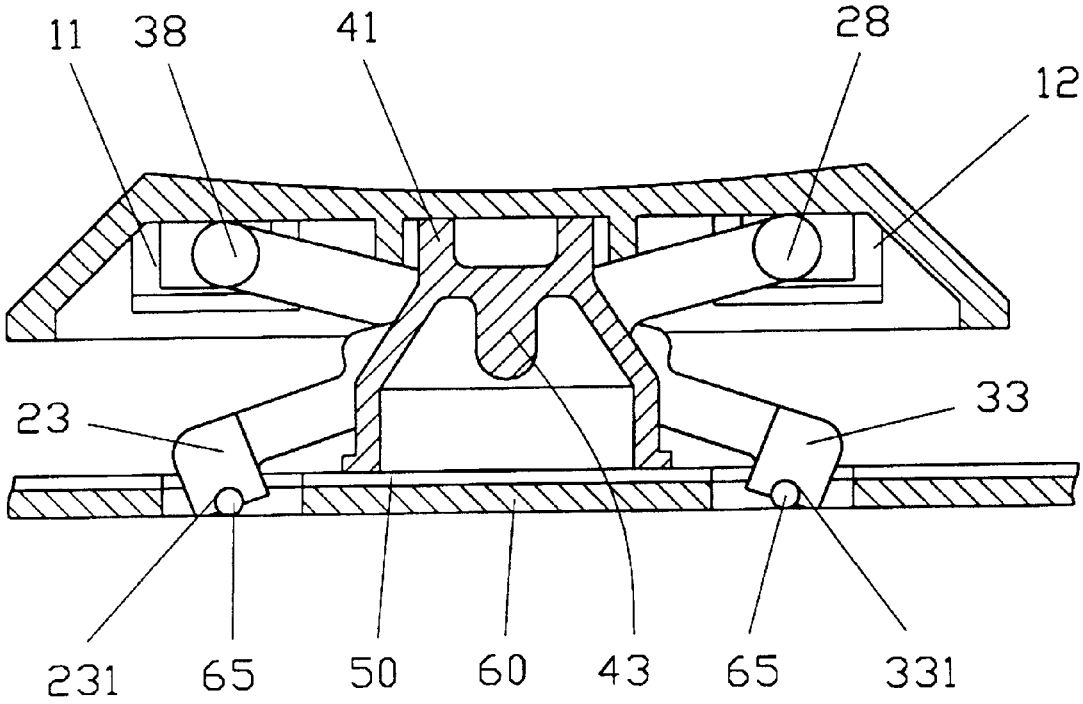
FIG. 3 is a cross-sectional view of the assembled pushbutton of FIG. 2.

Referring to the drawings and in particular to FIGS. 2 and 3, a computer keyboard pushbutton constructed in accordance with the present invention comprises a base plate 60 on which a membrane circuit 50 is positioned. A deformable rubber cap 40 is positioned on the membrane circuit 50. A pair of link members 20, 30 pivotally attached to each other to form a cross configuration are pivotally supported by the base plate 60 for supporting a key cap 10 to which the rubber cap 40 is coupled. The rubber cap 40 and the membrane circuit 50 are located between the link members 20, 30 and the base plate 60 whereby depression of the key cap 10 causes collapse of the cross configuration of the link members 20, 30 and deforms the rubber cap 40 to engage with and thus actuate the membrane circuit 50.

The link members 20, 30 each comprise two spaced bars 22, 24 and 32, 34 connected together by a cross bar 25, 35 to form an "H" shape. The bars 22, 24 of the first link member 20 each form a pivot pin 221, 241. The bars 32, 34 of the second link member 3 each define hole 321, 341. The bars 32, 34 of the second link member 30 are received between the bars 22, 24 of the first link member 20 respectively adjacent thereto for receiving the pivot pins 221, 241 in the holes 321, 341 thereby pivotally attaching the second link member 30 to the first link member 20 to form the cross configuration which is collapsible from an initial expanded position where the link members 20, 30 are substantially normal to each other to a collapsed position where the link members 20, 30 substantially overlap each other.

Each bar 22, 24, 32, 34 has a first end with a block 21, 23, 31, 33 formed thereon and defining a groove 211, 231, 311, 331 having a C-shaped cross section for snappingly fitting over a corresponding trunnion 65 formed on the base plate 60. Each bar 22, 24, 32, 34 also has a second end forming a pin 26, 28, 36, 38 movably received in a corresponding elongate slot 110, 120 defined in a tab 11, 12 formed on an underside of the key cap 10 thereby movably supporting the key cap 10 on the base plate 60. Depression of the key cap 10 collapses the cross configuration of the link members 20, 30 from the expanded position to the collapsed position and deforms the rubber cap 40 to actuate the membrane circuit 50.

The base plate 60 defines two openings 62, 64 separated by a partition strip 63. The partition strip 63 has an expanded circular portion 61. Two of pegs 65 extend into each opening 62, 64 for snappingly fitting into the corresponding grooves 211, 231, 311, 331 thereby rotatably supporting the link members 20, 30. The membrane circuit 50 comprises an insulative film 56 supported on the base plate 60. Two openings 51 are defined in the insulative film 56 corresponding to the openings 62, 64 of the base plate 60 for extension of the first ends of the link members 20, 30 therethrough.

The grooves 211, 231, 311, 331 defined in the first ends of the link members 20, 30 are thus readily engageable with the pegs 65 of the base plate 60.

The insulative film 56 of the membrane circuit 50 comprises a strip 53 partitioning the two openings 51 and having an expanded circular portion 52 positioned on and supported by the strip 63 and the expanded portion 61 of the base plate 60. A contact switch 54 is formed in the expanded portion 52 of the insulative film 56 and conductive traces 55 extending therefrom are formed on the strip 53.

The rubber cap 40 comprises a hollow cap body 42 positioned on the expanded portion 52 and a free end 41 extending from the cap body 42 for being received in a bore 13 defined in the underside of the key cap 10 thereby coupling the rubber cap 40 to the key cap 10. The cross bars 25, 35 of the link members 20, 30 are distanced from each other to define a space therebetween for the extension of the free end 41 of the rubber cap 40 to engage with the bore 13 of the key cap 10.

The rubber cap 40 comprises an inward projection 43 formed inside the hollow body 41 and corresponding in position to the free end 41 and the contact switch 54 of the membrane circuit 50 whereby depressing the key cap 10 by applying an external force thereto causes the rubber cap 40 to deform which moves the inward projection 43 to contact and thus actuate the contact switch 54 of the membrane circuit 50.

Since the rubber cap 40 is resilient, the link members 20, 30 resile to the expanded position when the external force applied to the key cap 10 is removed and the contact switch 54 is de-actuated.

Figure 4:
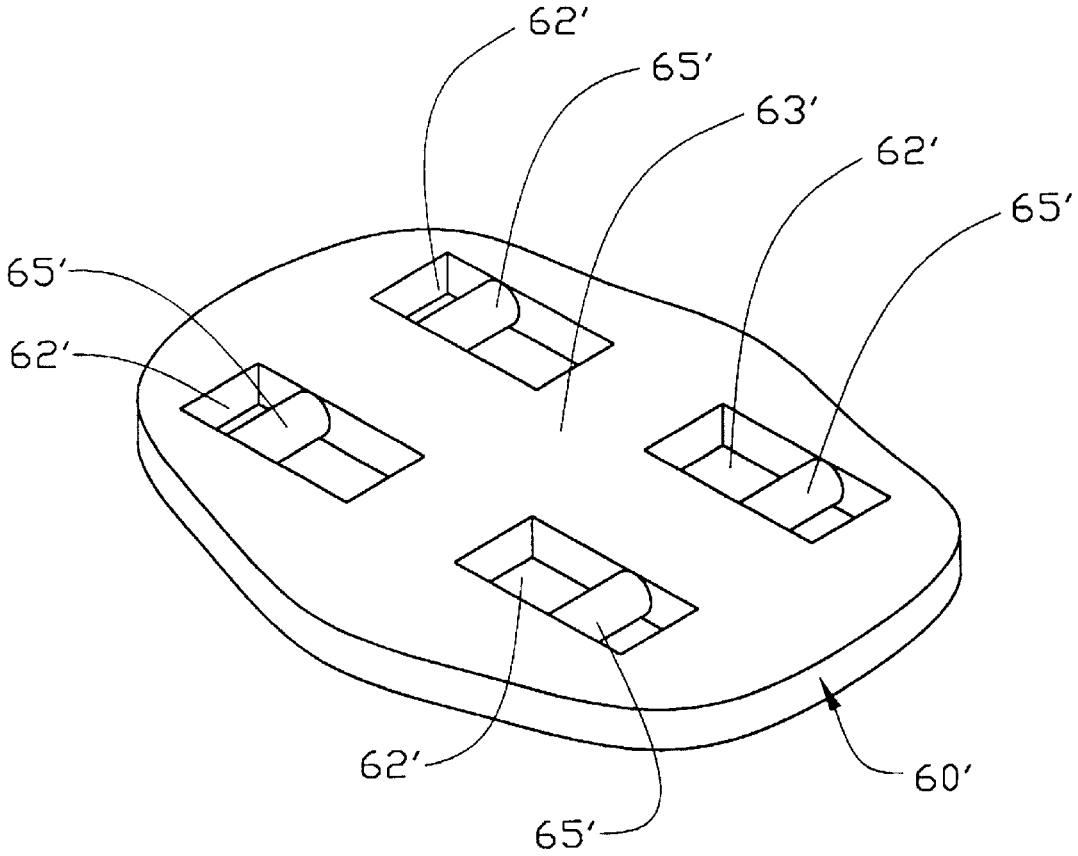
FIG. 4 is a perspective view of a base member of a pushbutton of a computer keyboard constructed in accordance with a second embodiment of the present invention.

It is not necessary to form the openings 64 for the provision of the pegs 65 on the base plate 60. FIG. 4 shows another embodiment of the base plate which is designated by reference numeral 60' for distinction. The base plate 60' defines four small openings 62' each having a peg 65' formed therein. A solid connection 63' is provided between the small openings 62' for supporting the traces 55 and the contact switch 54 of the membrane circuit 50.

It is apparent that the pegs 65 may be formed on the base plate in other ways provided the contact switch 54 is soundly supported by the base plate so that when a force is applied thereto by the inward projection 43 of the rubber cap 40 when the key cap 10 is depressed, the contact switch 54 is accurately actuated.

Although the present invention has been described with reference to the preferred embodiments, it is apparent to those skilled in the art that a variety of modifications and changes may be made without departing from the scope of the present invention which is intended to be defined by the appended claims.

What is claimed is:

1. A pushbutton structure comprising a base plate, a first link member and a second link member pivotally attached to each other to form a collapsible cross configuration supported on the base plate, a key cap supported on the link members and movable with the collapse of the cross configuration of the link members, and a membrane circuit positioned on and supported by the base plate, the membrane circuit comprising an insulative film on which a contact switch and corresponding conductive traces are formed, and a deformable member supported on the membrane circuit and coupled to the key cap for being deformed by the movement of the key cap to cause a portion of the deformable member to contact and thus actuate the contact switch, each of the first and second link members comprising two spaced bars connected together by a cross bar, each bar of the first and second link members forming a lower end with a block and a groove defined in the block for snappingly fitting over a corresponding peg formed on the base plate.

2. The pushbutton structure as claimed in claim 1, wherein each bar of the first and second link members having an upper end opposite to the lower end thereof slidably received in an elongate slot defined in an underside of the key cap.

3. The pushbutton structure as claimed in claim 1, wherein the first link member comprises a pivot pin formed on each bar thereof and the second link member defines a corresponding hole in each bar thereof for rotatably receiving the pivot pin of the corresponding bar of the first link member thereby pivotally attaching the link members together.

4. The pushbutton structure as claimed in claim 1, wherein the insulative film of the membrane circuit defines two openings separated by a partition strip having an expanded portion, the contact switch being formed on the expanded portion with the conductive traces extending along the partition strip.

5. The pushbutton structure as claimed in claim 4, wherein the base plate defines two openings corresponding to the openings of the insulative film of the membrane circuit, the two openings being separated by a strip having an expanded portion for supporting the strips and the expanded portion of the insulative film of the membrane circuit thereon, two pegs being formed on the base plate and extending into corresponding openings of the base plate for pivotally supporting corresponding lower ends of the bars of the corresponding first and second link members.

6. The pushbutton structure as claimed in claim 4, wherein the base plate defines four openings corresponding to the openings of the insulative film of the membrane circuit each forming a peg therein for pivotally supporting the corresponding first and second link members, a solid section being formed between the openings of the base plate for supporting the contact switch of the membrane circuit.

7. The pushbutton structure as claimed in claim 1, wherein the deformable member comprises a deformable cap coupled to and driven by the key cap thereby moving a projection extending inward therefrom to contact and thus to actuate the contact switch.

8. The pushbutton structure as claimed in claim 7, wherein the deformable member is made of rubber.

9. A push button structure comprising a base plate, first and second link members pivotally attached to each other to form a collapsible cross configuration supported on the base plate through bottom ends of the link members, a key cap supported on the link members through upper ends of the link members and movable with a collapsing of the cross configuration of the link members, and a membrane circuit positioned on and supported by the base plate, the membrane circuit comprising an insulative film on which a contact switch and corresponding traces are formed, and a deformable member supported on the membrane circuit and coupled to the key cap for being deformed by movement of the key cap to cause a portion of the deformable member to contact and thus actuate the contact switch; wherein said base plate defines an opening, and means for pivotal engagement with said bottom ends of the link members is positioned in said opening, and wherein said means includes at least a peg integrally extending from the base plate in the opening without projecting above an upper surface of the base plate.

* * * * *